US010107276B2

(12) United States Patent
Jeong et al.

(10) Patent No.: US 10,107,276 B2
(45) Date of Patent: Oct. 23, 2018

(54) LINEAR COMPRESSOR HAVING A DEFORMATION PREVENTION INNER STATOR

(71) Applicant: LG ELECTRONICS INC., Seoul (KR)

(72) Inventors: Sangsub Jeong, Seoul (KR); Jongkoo Lee, Seoul (KR); Jehoon Kim, Seoul (KR); Ochang Gwon, Seoul (KR)

(73) Assignee: LG Electronics Inc., Seoul (KR)

( * ) Notice: Subject to any disclaimer, the term of this patent is extended or adjusted under 35 U.S.C. 154(b) by 297 days.

(21) Appl. No.: 14/814,562

(22) Filed: Jul. 31, 2015

(65) Prior Publication Data

US 2016/0053752 A1 Feb. 25, 2016

(30) Foreign Application Priority Data

Aug. 25, 2014 (KR) ..... 10-2014-0110639

(51) Int. Cl.
*F04B 35/04* (2006.01)
*F04B 17/04* (2006.01)
*F04B 39/12* (2006.01)

(52) U.S. Cl.
CPC ..... *F04B 35/045* (2013.01); *F04B 17/04* (2013.01); *F04B 35/04* (2013.01); *F04B 39/121* (2013.01)

(58) Field of Classification Search
CPC ..... F04B 17/04; F04B 17/046; H02K 1/12; H02K 33/00; H02K 33/02; H02K 33/06; H02K 41/00

(Continued)

(56) References Cited

U.S. PATENT DOCUMENTS 5,315,190 A * 5/1994 Nasar ..... H02K 35/06 310/12.15
5,945,748 A * 8/1999 Park ..... F04B 35/045 310/12.23

(Continued)

FOREIGN PATENT DOCUMENTS

CN 1200592 A 12/1998
CN 1574568 A 2/2005

(Continued)

OTHER PUBLICATIONS

Translate KR KR 100595728, Espacenet Jun. 22, 2017, machine translation, pp. 1-6.*

(Continued)

*Primary Examiner* — Bryan Lettman
*Assistant Examiner* — Timothy Solak
(74) *Attorney, Agent, or Firm* — Fish & Richardson P.C.

(57) ABSTRACT

A linear compressor includes a cylinder defining a compression space for a refrigerant, a piston reciprocated in an axis direction within the cylinder, and a linear motor providing power to the piston. The linear motor includes an inner stator disposed outside the cylinder, the inner stator including a center core and a side core disposed on at least one side of the center core, an outer stator disposed to be spaced outward from the inner stator in a radius direction, a permanent magnet movably disposed in an air gap defined between the inner stator and the outer stator, and a deformation prevention device for preventing the inner stator from being deformed.

22 Claims, 10 Drawing Sheets

(58) Field of Classification Search
USPC ..... 310/12.01, 23, 34
See application file for complete search history.

(56) References Cited

U.S. PATENT DOCUMENTS

| | | | | |
|---|---|---|---|---|
| 7,075,199 | B2 * | 7/2006 | Kang | F04B 35/045 310/12.16 |
| 7,157,814 | B2 | 1/2007 | Park | |
| 2006/0017332 | A1 * | 1/2006 | Kang | F04B 35/045 310/15 |
| 2006/0091735 | A1 * | 5/2006 | Song | F04B 17/04 310/12.25 |
| 2007/0057580 | A1 * | 3/2007 | Starke | F04B 35/045 310/15 |

FOREIGN PATENT DOCUMENTS

| | | | | |
|---|---|---|---|---|
| CN | 1728516 | A | 2/2006 | |
| CN | 1856922 | A | 11/2006 | |
| CN | 1975160 | A | 6/2007 | |
| KR | 10-0529942 | | 11/2005 | |
| KR | 2005104277 | A | 11/2005 | |
| KR | 10-0595728 | * | 7/2006 | H02K 41/02 |
| KR | 2006086682 | A | 8/2006 | |
| KR | 10-0012711 | * | 2/2008 | F04B 17/04 |
| KR | 802622 | A | 2/2008 | |
| KR | 20080012711 | * | 2/2008 | F04B 17/04 |
| KR | 10-1149674 | | 6/2012 | |

OTHER PUBLICATIONS

TranslationKR20080012711, machine translation of KR 20080012711; Espacenet.com, Jan. 9, 2018, pp. 1-2.*

International Search Report issued for International Application No. PCT/KR2015/008078 dated Oct. 27, 2015, 3 pages.

Chinese Office Action in Chinese Application No. 201580042593.0, dated Feb. 9, 2018, 21 pages.

Extended European Search Report in European Application No. 15835082.7, dated Mar. 1, 2018, 15 pages.

* cited by examiner

LINEAR COMPRESSOR HAVING A DEFORMATION PREVENTION INNER STATOR

CROSS-REFERENCE TO RELATED APPLICATIONS

The present application claims priority under 35 U.S.C. 119 and 35 U.S.C. 365 to Korean Patent Application No. 10-2014-0110639 (filed on Aug. 25, 2014), which is hereby incorporated by reference in its entirety.

BACKGROUND

The present disclosure relates to a linear compressor.

In general, compressors are machines that receive power from a power generation device such as an electric motor or turbine to compress air, a refrigerant, or various working gases, thereby increasing in pressure. Compressors are being widely used in home appliances such as refrigerators or air conditioners or industrial fields.

Compressors may be largely classified into reciprocating compressors in which a compression space into/from which a working gas is suctioned and discharged is defined between a piston and a cylinder to allow the piston to be linearly reciprocated into the cylinder, thereby compressing a refrigerant, rotary compressors in which a compression space into/from which a working gas is suctioned or discharged is defined between a roller that eccentrically rotates and a cylinder to allow the roller to eccentrically rotate along an inner wall of the cylinder, thereby compressing a refrigerant, and scroll compressors in which a compression space into/from which is suctioned or discharged is defined between an orbiting scroll and a fixed scroll to compress a refrigerant while the orbiting scroll rotates along the fixed scroll.

In recent years, a linear compressor which is directly connected to a driving motor, in which a position is linearly reciprocated, to improve compression efficiency without mechanical losses due to movement conversion and has a simple structure is being widely developed.

The linear compressor may suction and compress a refrigerant while a piston is linearly reciprocated in a sealed shell by a linear motor and then discharge the refrigerant.

The linear motor is configured to allow a permanent magnet to be disposed between an inner stator and an outer stator. The permanent magnet may be linearly reciprocated by an electromagnetic force between the permanent magnet and the inner (or outer) stator. Also, since the permanent magnet operates in the state where the permanent magnet is connected to the piston, the permanent magnet may suction and compress the refrigerant while being linearly reciprocated within the cylinder and then discharge the refrigerant.

FIG. 1 is a partial view of a linear motor provided in a linear compressor according to a related art, and FIG. 2 is a view illustrating a state in which the linear motor is deformed after being assembled.

Referring to FIG. 1, a linear motor 1 according to the related part includes an inner stator.

In detail, the inner stator includes a first core 2 and second cores 3*a* and 3*b* coupled to both sides of the first core 2. The second cores 3*a* and 3*b* may be formed by radially stacking a plurality of core plates.

The second cores 3*a* and 3*b* include tips 6*a* and 6*b* defining outer diameters R with respect to central lines C1 of the second cores 3*a* and 3*b*, respectively. The tips 6*a* and 6*b* are disposed to face each other and to be spaced apart from each other.

The second cores 3*a* and 3*b* may be deformable by force F that acts when the plurality of core plates are assembled. Also, the second cores 3*a* and 3*b* may be more deformable by force F that acts when being assembled with the first core 2.

Particularly, the tips 6*a* and 6*b* of the second cores 3*a* and 3*b* may be spread outward by the above-described deformation of the second cores 3*a* and 3*b*, and thus, each of the second cores 3*a* and 3*b* may increase in outer diameter. That is, referring to FIG. 2, virtual lines l1 and l2 extending from outer circumferential surfaces of the second cores 3*a* and 3*b* may be inclined with respect to the central lines C1, respectively.

When each of the second cores 3*a* and 3*b* increases in outer diameter, an airgap with an outer stator (not shown) may be limited in maintenance to deteriorate operation efficiency of the motor.

The phenomenon in which each of the second cores 3*a* and 3*b* increases in outer diameter may be more intensified by the external force transferred from a predetermined component of a compressor when the linear motor is installed in the linear compressor. For example, the predetermined component may be a stator cover or frame that is coupled to one side of each of the second cores 3*a* and 3*b*.

SUMMARY

Embodiments provide a linear compressor including a linear motor that is capable of being firmly assembled.

In one embodiment, a linear compressor includes: a cylinder defining a compression space for a refrigerant; a piston reciprocated in an axis direction within the cylinder; and a linear motor providing power to the piston, wherein the linear motor includes: an inner stator disposed outside the cylinder, the inner stator including a center core and a side core disposed on at least one side of the center core; an outer stator disposed to be spaced outward from the inner stator in a radius direction; a permanent magnet movably disposed in an air gap defined between the inner stator and the outer stator; and a deformation prevention device for preventing the inner stator from being deformed.

The deformation prevention device may include: a hook disposed on the side core; and a hook coupling part disposed on the center core, the hook coupling part being coupled to the hook.

The side core may include: a core body coupled to a stator cover or frame; a tip extending from one side of the core body; and a protrusion protruding from the other side of the core body, wherein the hook may be disposed on the protrusion.

The side core may include: a first side core coupled to a front portion of the center core; and a second side core coupled to a rear portion of the center core.

The tip disposed on the first side core and the tip disposed on the second side core may be disposed to be spaced apart from each other and face each other.

The inner stator may include: a bobbin disposed in a space defined by the center core and the first and second side cores; and a coil wound around the bobbin.

The first side core may have an inner surface coupled to the bobbin and an outer surface coupled to the stator cover, and the second side core may have an inner surface coupled to the bobbin and an outer surface coupled to the frame.

The hook coupling part may include a recess part that is recessed in an outer circumferential surface of the center core so that the hook is inserted therein.

The side core may be formed by stacking a plurality of core plates in a circumferential or radial direction.

The side core may further include a side fixing member coupled to the plurality of core plates to maintain an assembled state of the plurality of core plates.

The deformation prevention device may include: a first fixing member disposed on one surface of the side core to fix the plurality of core plates; and a second fixing member disposed on the other surface of the side core to fix the plurality of core plates.

The outer surface of the side core may be a surface coupled to the bobbin around which the coil is wound.

The second fixing member may be formed of a nonconductive material.

In another embodiment, a linear compressor includes: a cylinder defining a compression space for a refrigerant; a piston reciprocated in an axis direction within the cylinder; and a linear motor providing power to the piston, wherein the linear motor includes: an inner stator disposed outside the cylinder, the inner stator including a center core and a side core disposed on at least one side of the center core; an outer stator disposed to be spaced outward from the inner stator in a radius direction; a permanent magnet movably disposed in an air gap defined between the inner stator and the outer stator; a hook disposed on the side core; and a hook coupling part disposed on the center core, the hook coupling part being hooked with the hook.

The side core may include: a plurality of core plates that are stacked on each other; and a side fixing member coupled to the plurality of core plates.

The side core may include first and second side cores coupled to both sides of the center core, and the hook coupling part is disposed at two positions to correspond the first and second side cores.

The linear compressor may further include: a bobbin disposed between an inner surface of the first side core and an inner surface of the second side core; and a coil coupled to the bobbin.

The details of one or more embodiments are set forth in the accompanying drawings and the description below. Other features will be apparent from the description and drawings, and from the claims.

DETAILED DESCRIPTION OF THE EMBODIMENTS

Hereinafter, exemplary embodiments will be described with reference to the accompanying drawings. The invention may, however, be embodied in many different forms and should not be construed as being limited to the embodiments set forth herein; rather, that alternate embodiments included in other retrogressive inventions or falling within the spirit and scope of the present disclosure will fully convey the concept of the invention to those skilled in the art.

Figure 1:
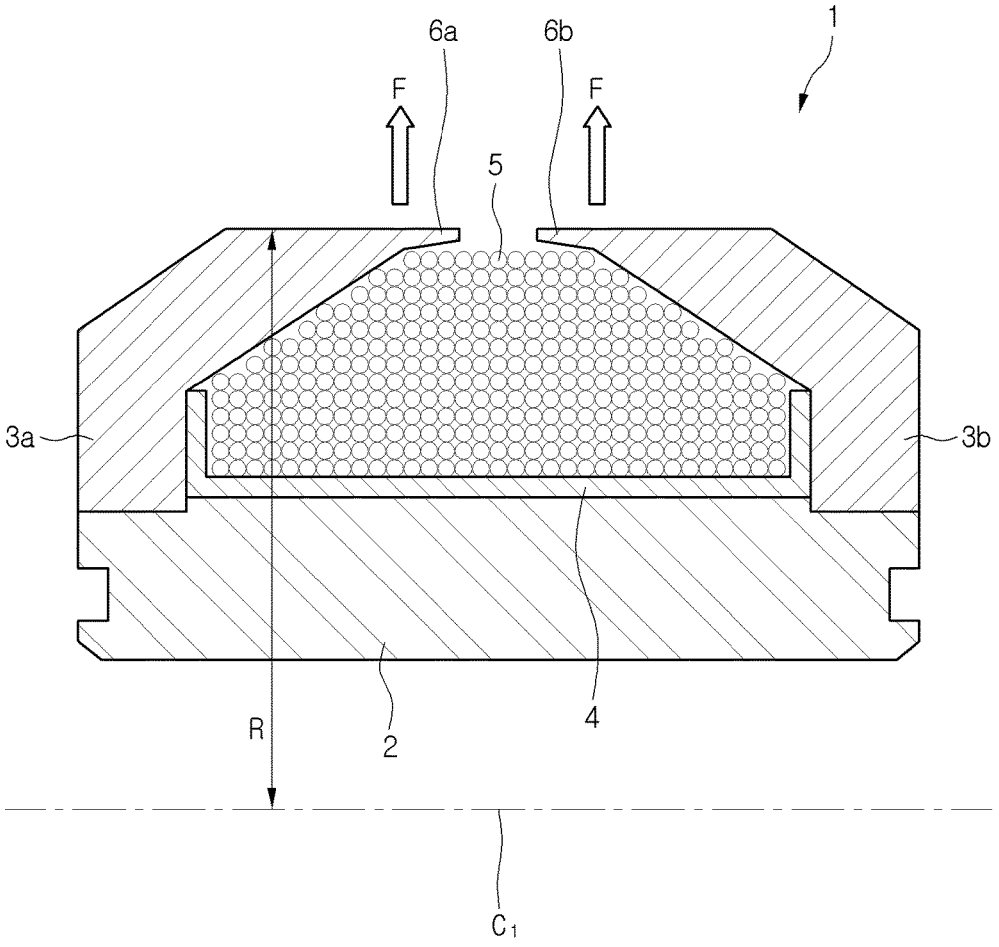
Fig. 1 Related Art
FIG. 1 is a partial view of a linear motor provided in a linear compressor according to a related art.
Figure 2:
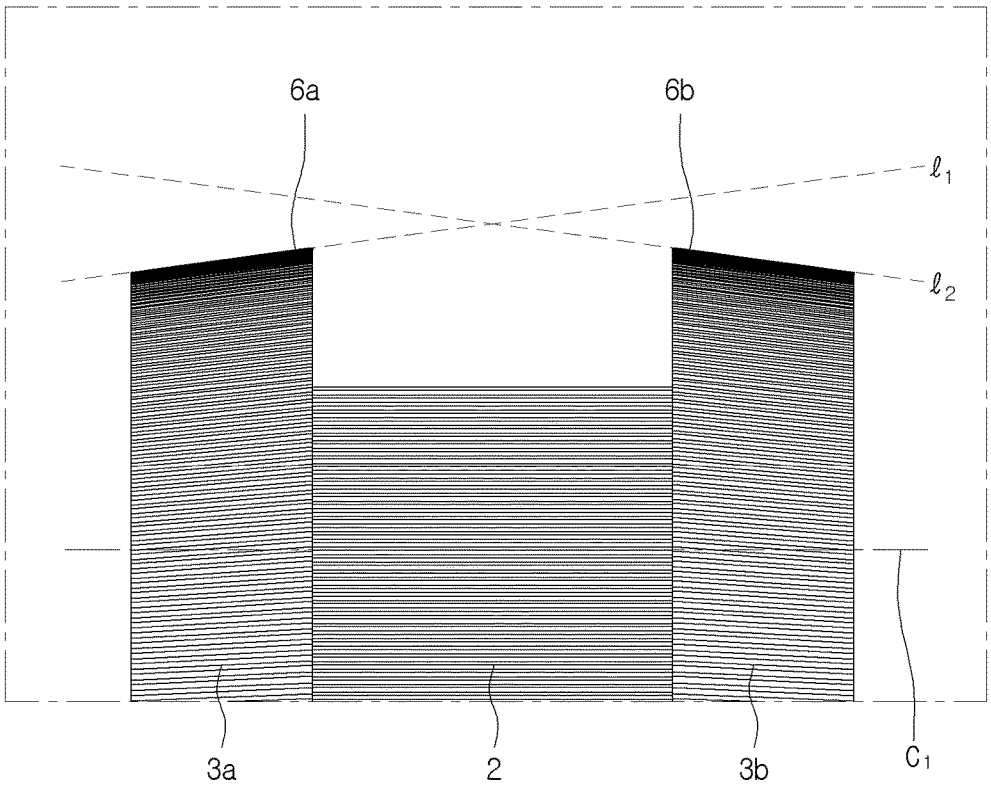
Fig. 2 Related Art
FIG. 2 is a view illustrating a state in which the linear motor is deformed after being assembled.
Figure 3:
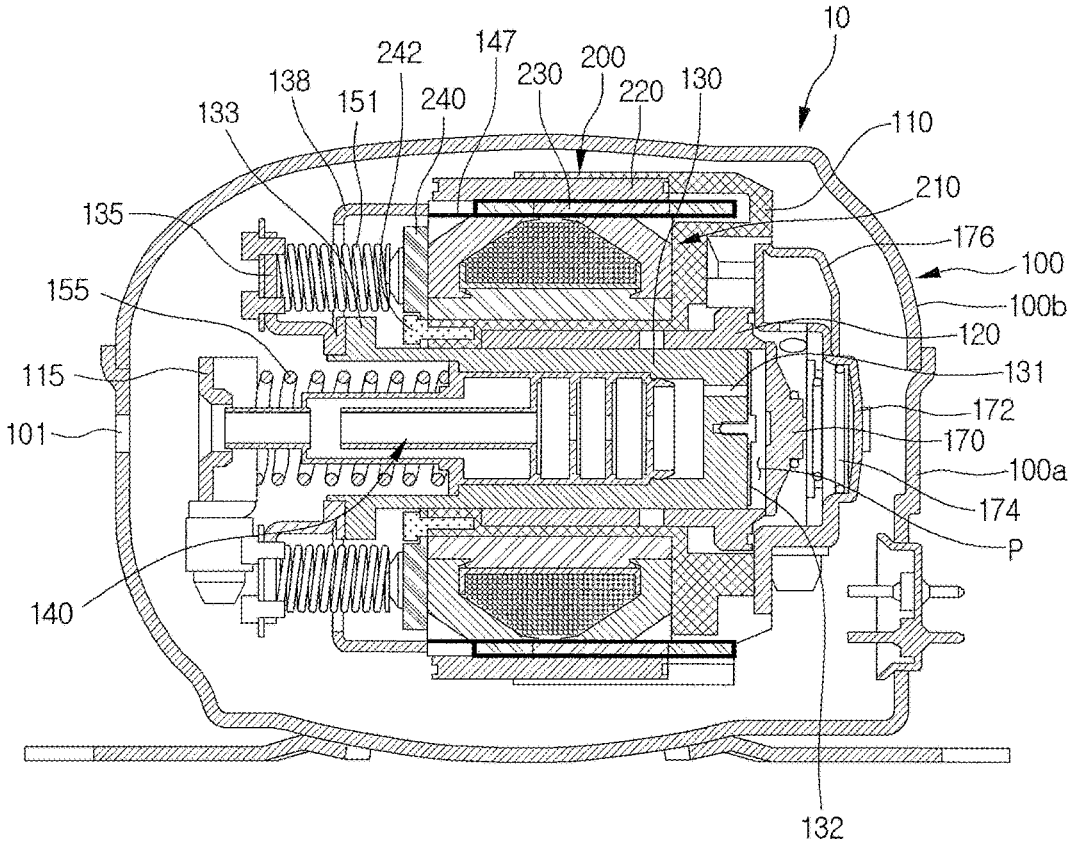
FIG. 3 is a cross-sectional view of a linear compressor according to a first embodiment.

FIG. 3 is a cross-sectional view of a linear compressor according to a first embodiment.

Referring to FIG. 3, a linear compressor 10 according to the first embodiment includes a cylinder 120 provided in the shell 101, a piston 130 that is linearly reciprocated within the cylinder 120, and a motor assembly 200 that serves as a linear motor for applying a driving force to the piston 130. The shell 100 may be formed by coupling a lower shell 100*a* to an upper shell 100*b*.

The shell 100 includes a suction part 101 through which a refrigerant is introduced and a discharge part (not shown) through which the refrigerant compressed in the cylinder 120 is discharged. The refrigerant suctioned through the suction part 101 flows into the piston 130 via a suction muffler 140. The suction muffler 140 is disposed in the piston 130 to reduce noises while the refrigerant passes through the suction muffler 140.

The piston 130 may be formed of an aluminum material (aluminum or an aluminum alloy) that is a nonmagnetic material. Since the piston 130 is formed of the aluminum material, a flux generated in the motor assembly 200 may be transmitted into the piston 130 to prevent the flux from leaking to the outside of the piston 130.

The cylinder 120 may be formed of an aluminum material (aluminum or an aluminum alloy) that is a nonmagnetic material. Also, the cylinder 120 and the piston 130 may have the same material composition, i.e., the same kind and composition.

Since the piston 120 is formed of the aluminum material, the flux generated in the motor assembly 200 may be transmitted into the piston 120 to prevent the flux from leaking to the outside of the piston 120.

Also, since the piston 130 is formed of the same material (aluminum) as the cylinder 120, the piston 130 may have the same thermal expansion coefficient as the cylinder 120. When the linear compressor 10 operates, an high-temperature (a temperature of about 100° C.) environment may be created within the shell 100. Thus, since the piston 130 and the cylinder 120 have the same thermal expansion coefficient, the piston 130 and the cylinder 120 may be thermally deformed by the same degree.

As a result, the piston 130 and the cylinder 120 may be thermally deformed with sizes and in directions different from each other to prevent the piston 130 from interfering with the cylinder 120 while the piston 130 moves.

The cylinder 120 has a compression space P in which the refrigerant is compressed by the piston 130. Also, a suction hole 131 through which the refrigerant is introduced into the compression space P is defined in the piston 130, and a suction valve 132 for selectively opening the suction hole 131 is disposed outside the suction hole 133.

Discharge valve assemblies 170, 172, and 174 for discharging the refrigerant compressed in the compression space P are disposed on one side of the compression space P. That is, the compression space P may be understood as a space defined between the piston 130 and the discharge valve assemblies 170, 172, and 174.

The discharge valve assemblies 170, 172, and 174 include a discharge cover 172 defining a discharge space of the refrigerant, a discharge valve 170 that is opened when a pressure in the compression space P is above a discharge pressure to introduce the refrigerant into the discharge space, and a valve spring 174 disposed between the discharge valve 170 and the discharge cover 172 to apply an elastic force in an axis direction.

Here, the "axial direction" may be understood as a direction in which the piston 130 is reciprocated, i.e., a transverse direction in FIG. 3. On the other hand, a "radius direction" may be understood as a direction that is perpendicular to the direction in which the piston 130 is reciprocated, i.e., a horizontal direction in FIG. 3.

The suction valve 132 may be disposed on one side of the compression space P, and the discharge valve 170 maybe disposed on the other side of the compression space P, i.e., an opposite side of the suction valve 132.

While the piston 130 is linearly reciprocated within the cylinder 120, when the pressure of the compression space P is below the discharge pressure and a suction pressure, the suction valve 132 may be opened to suction the refrigerant into the compression space P. On the other hand, when the pressure of the compression space P is above the suction pressure, the suction valve 132 may compress the refrigerant of the compression space P in a state where the suction valve 135 is closed.

When the pressure of the compression space P is above the discharge pressure, the valve spring 174 may be deformed to open the discharge valve 170. Here, the refrigerant may be discharged from the compression space P into the discharge space of the discharge cover 172.

Also, the refrigerant in the discharge space is introduced into a loop pipe (not shown) via the discharge muffler 176. The discharge muffler may reduce flow noises of the compressed refrigerant, and the loop pipe may guide the compressed refrigerant into the discharge part.

The linear compressor 10 further includes a frame 110. The frame 110 may fix the cylinder 120 and be integrated with the cylinder 120 or coupled to the cylinder 120 by using a separate coupling member. Also, the discharge cover 172 may be coupled to the frame 110.

The motor assembly 200 includes an inner stator 210 fixed to the frame 110 and disposed to surround the cylinder 120, an outer stator 220 disposed to be spaced outward in a radius direction of the inner stator 210, and a permanent magnet 230 disposed in a space between the inner stator 210 and the outer stator 220.

The permanent magnet 230 may be linearly reciprocated by a mutual electromagnetic force between the outer stator 210 and the inner stator 220. Also, the permanent magnet 230 may be formed by coupling a plurality of magnets having three polarities. Alternatively, the permanent magnet 230 may be provided as a magnet having one polarity. Also, the permanent magnet 230 may be formed of a ferrite material.

The permanent magnet 230 may be coupled to the piston 130 by a connection member 138. The connection member 138 may be coupled to a flange part 133 of the piston 130 to extend from the permanent magnet 230. As the permanent magnet linearly moves, the piston 120 may be linearly reciprocated in an axis direction together with the permanent magnet 230.

Also, the linear compressor 10 further includes fixing member 147 for fixing the permanent magnet 230 to the connection member 138. The fixing member 147 may be formed of a composition in which a glass fiber or carbon fiber is mixed with a resin. The fixing member 147 may be provided to surround the outside of the permanent magnet 230 to firmly maintain the coupled state between the permanent magnet 230 and the connection member 138.

The stator cover 240 is disposed outside the inner stator 210. The stator cover 240 is coupled to the frame 110 by the coupling member 242. The inner stator 210 may have one side supported by the frame 110 and the other side supported by the stator cover 240. That is, the inner stator 210 may be disposed between the frame 110 and the stator cover 240.

The outer stator 220 is spaced inward from the inner stator 210 by an airgap in a radius direction and is fixed to the outside of the permanent magnet 230. Also, the outside of the outer stator 220 may be supported by the frame 110.

The outer stator 220 may be formed by stacking a plurality of thin plates in a circumferential or radial direction (a lamination structure).

The linear compressor 10 further includes a support 135 for supporting the piston 130. The support 135 may be coupled to the flange part 133 of the piston 130 to extend backward and then to extend in a radius direction.

The linear compressor 10 further includes a back cover 115 extending from the piston 130 to the suction part 101.

The linear compressor 10 includes a plurality of springs 151,155 that are adjustable in natural frequency to allow the piston 130 to perform a resonant motion.

The plurality of springs 151,155 include a first spring 151 supported between the support 135 and the stator cover 240 and a second spring 155 supported between the suction muffler 140 and the back cover 115.

The first spring 151 may be provided in plurality on both sides of the cylinder 120 or the piston 130. The second spring 155 may be provided in plurality toward a rear side of the suction muffler.

Here, the "rear side" may be understood as a direction from the piston 130 toward the suction part 101. Also, a direction from the suction part 101 toward the discharge valve assemblies 170, 172, and 174 may be understood as a "front side". These terms may be equally applied to the following descriptions.

Figure 4:
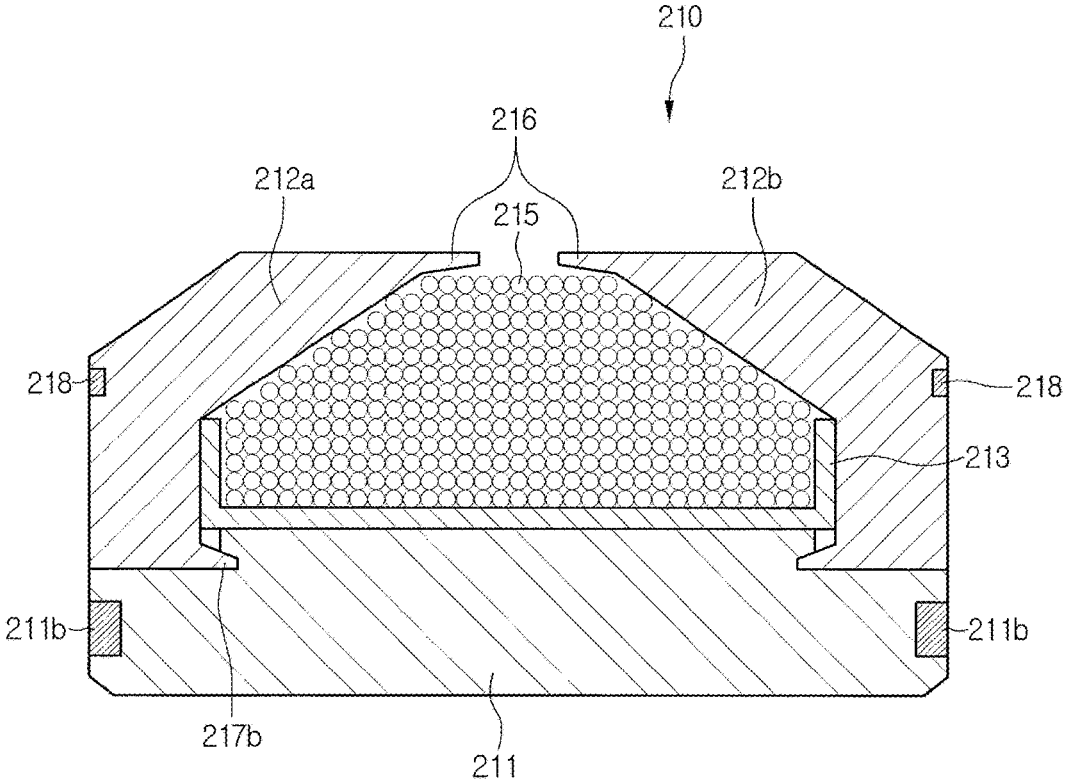
FIG. 4 is a cross-sectional view illustrating an inner stator of the linear compressor according to the first embodiment.
Figure 5:
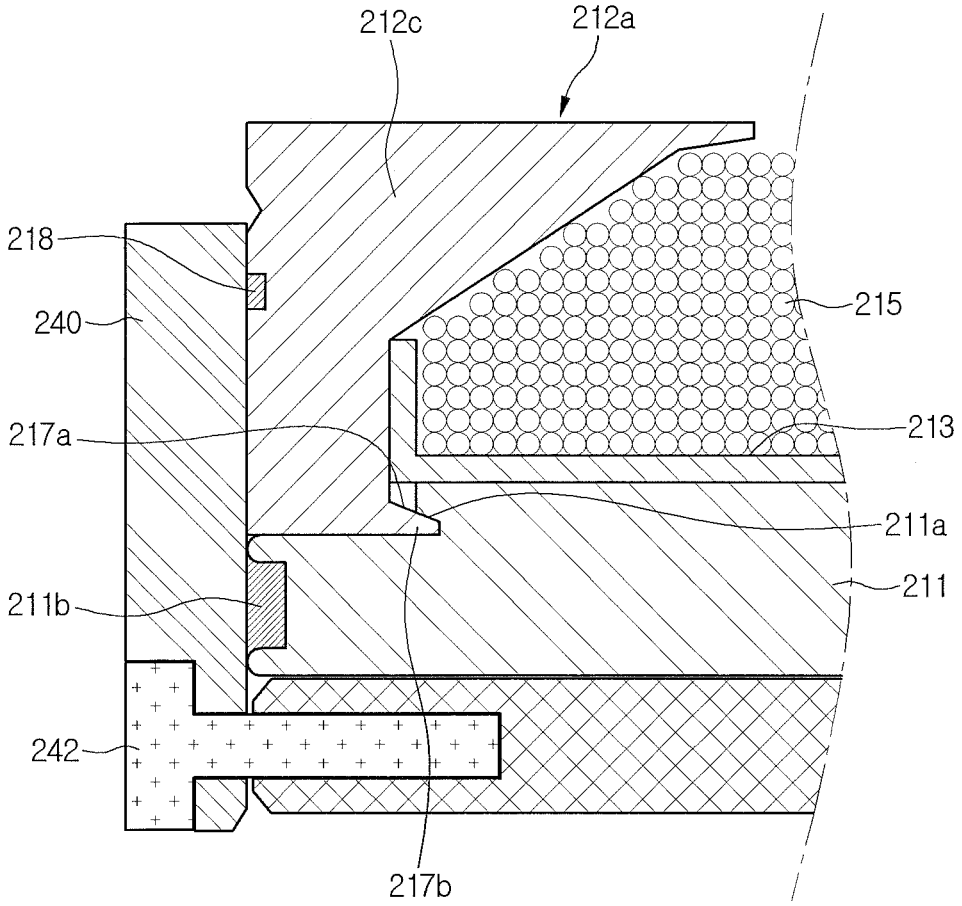
FIG. 5 is a cross-sectional view illustrating an assembled structure of the inner stator according to the first embodiment.
Figure 6:
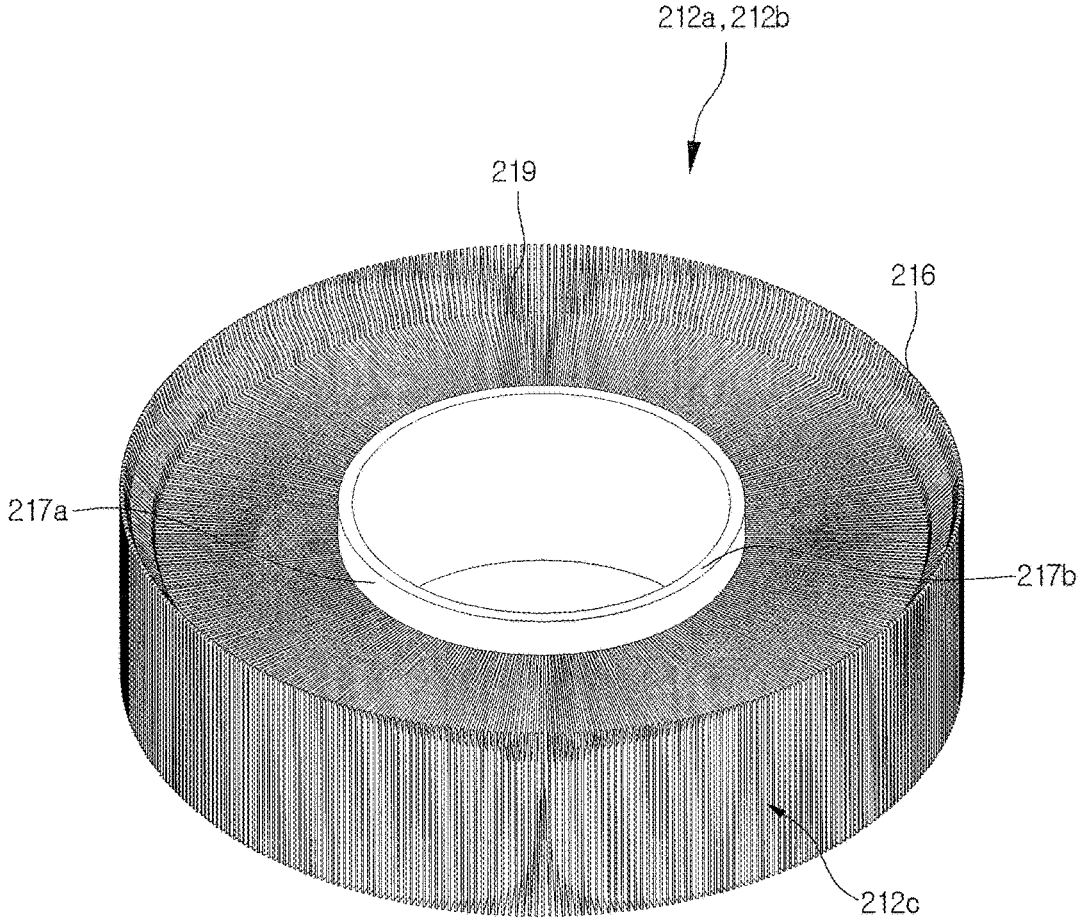
FIG. 6 is a view of a side core according to the first embodiment.
Figure 7:
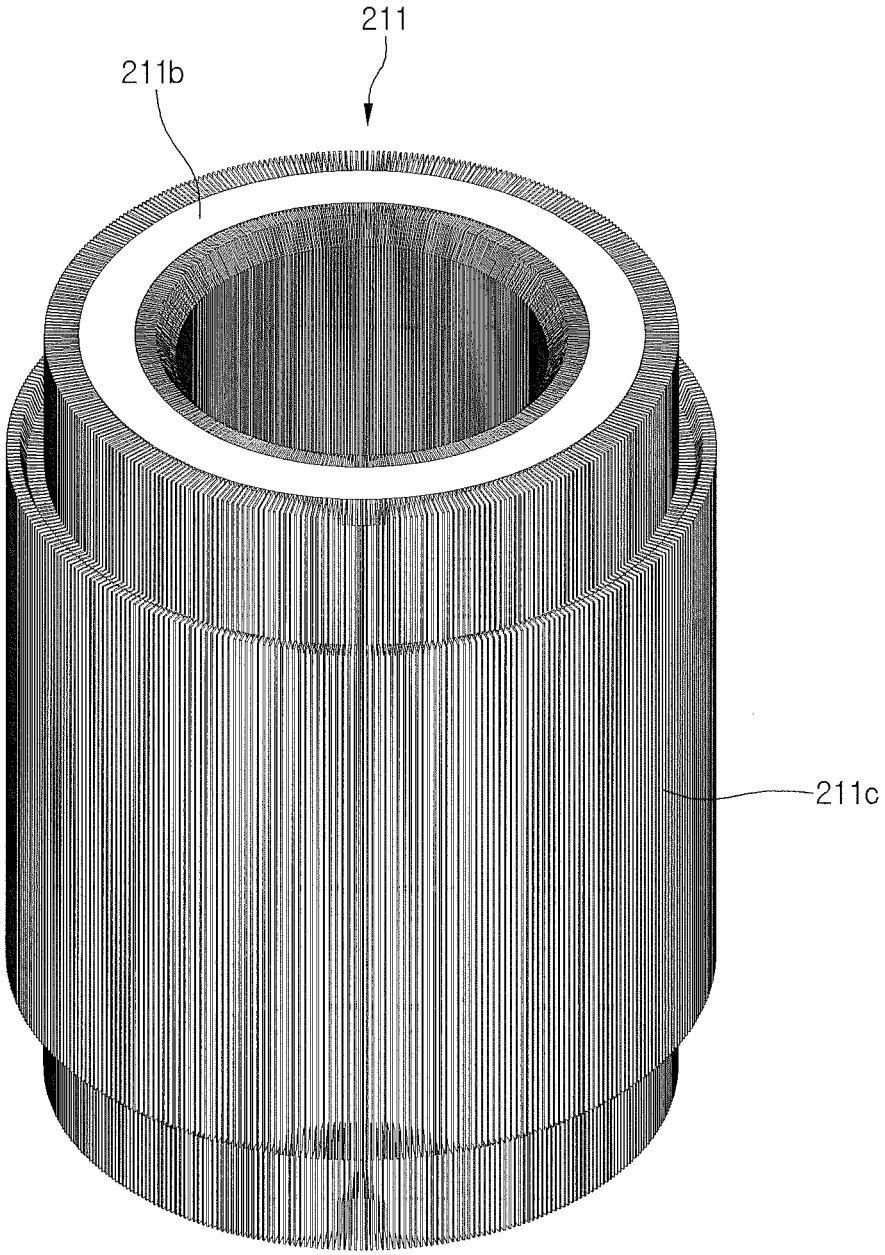
FIG. 7 is a view of a center core according to the first embodiment.
Figure 8:
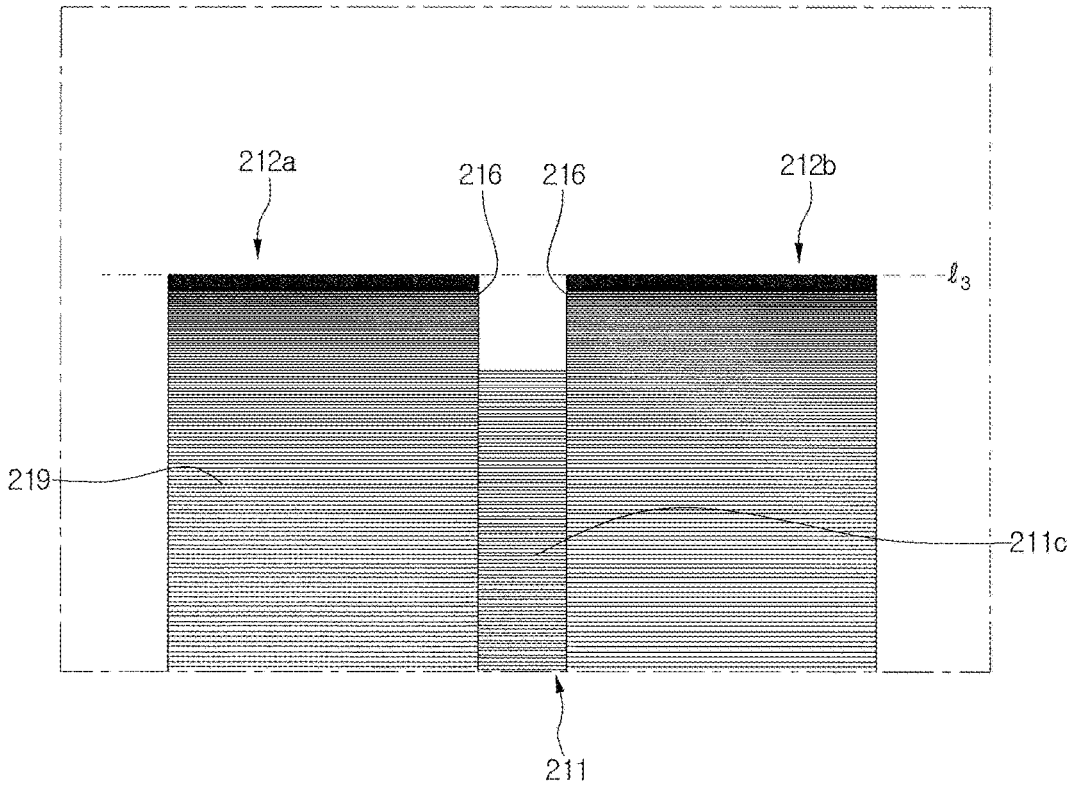
FIG. 8 is a view illustrating a state in which the center core and the side core are not deformed after being assembled according to the first embodiment.

FIG. 4 is a cross-sectional view illustrating the inner stator of the linear compressor according to the first embodiment, FIG. 5 is a cross-sectional view illustrating an assembled structure of the inner stator according to the first embodiment, FIG. 6 is a view of a side core according to the first embodiment, FIG. 7 is a view of a center core according to the first embodiment, and FIG. 8 is a view illustrating a state in which the center core and the side core are not deformed after being assembled according to the first embodiment.

Referring to FIGS. 4 and 7, the inner stator 210 according to the first embodiment includes a center core 211 extending in a front/rear direction and side cores 212*a* and 212*b* coupled to the outside of the center core 211. The side cores 212*a* and 212*b* include a first side core 212*a* and a second side core 212*b*.

The center core 211 is formed by stacking a plurality of core plates 211*c* in a circumferential or radial direction. The core plate 211 may have an approximately rectangular shape.

The center core 211 includes a center fixing member 211*b* for maintaining the state in which the plurality of core plates 211*c* that are stacked on each other are assembled. The center fixing member 211*b* may be a member having an approximately ring shape and be disposed on each of front and rear surfaces of the center core 211.

The plurality of core plates 211*c* fixed by the center fixing member 211*b* may constitute the center core 211 having an approximately hollow cylindrical shape.

The first and second side cores 212*a* and 212*b* may be assembled to both sides of the center core 211.

In detail, the first side core 212*a* may be coupled to a rear portion of the center core 211, and the second side core 212*b* may be coupled to a front portion of the center core 211. Also, the stator cover 240 may be coupled to the outside of the first side core 212*a*, and the frame 110 may be coupled to the outside of the second side core 212*b*.

Each of the first and second side cores 212*a* and 212*b* may be formed by stacking the plurality of core plates 219 in a circumferential or radial direction. The core plate 219 may have a polygonal shape having a bent portion. Also, the first and second side cores 212*a* and 212*b* may have shapes similar to each other.

Each of the first and second side cores 212*a* and 212*b* includes a side fixing member 218 for fixing the plurality of core plates 219 to maintain the assembled state. The side fixing member 218 may be understood as a ring member having an approximately ring shape and be disposed on each of outer surfaces of the first and second side cores 212*a* and 212*b*.

Also, the side fixing member 218 disposed on the first side core 212*a* may be disposed to face the stator cover 240, and the side fixing member 218 disposed on the second side core 212*b* may be disposed to face the frame 110.

Each of the first and second side cores 212*a* and 212*b* includes a core body 212*c* having an approximately annular shape, a tip 216 extending from one side of the core body 212*c*, and a protrusion 217*a* protruding from the other side of the core body 212*c*.

The tip 216 may be disposed on an outer circumferential surface of each of the first and second side cores 212*a* and 212*b*, and the protrusion 217*b* may be disposed on an inner circumferential surface of each of the first and second side cores 212*a* and 212*b*.

The tip 216 of the first side core 212*a* and the tip 216 of the second side core 212*b* may be disposed to be spaced apart from each other, thereby facing each other. The tip 216 of the first side core 212*a* may extend forward from an outer circumferential surface of the core body 212*c*, and the tip 216 of the second side core 212*b* may extend backward from an outer circumferential surface of the core body 212*c*.

Also, the protrusion 217*a* of the first side core 212*a* extends forward from the inner circumferential surface of the core body 212*c*, and the protrusion 217*a* of the second side core 212*b* extends backward from the inner circumferential surface of the core body 212*c*.

The inner stator 210 further includes coil winding bodies 213 and 215. The coil winding bodies 213 and 215 include a bobbin 213 and a coil 215 wound around an outer circumferential surface of the bobbin 213. The wound coil 215 may have a polygonal shape in section.

The bobbin 213 and the coil 215 may be disposed in a space defined by the center core 211 and the first and second side cores 212*a* and 212*b*.

The bobbin 213 may have a bent shape to be coupled to one surface of the center core 211 and one surface of each of the first and second side cores 212*a* and 212*b*.

A surface of the side core 212*a*, which is coupled to the bobbin 213 may be called an inner surface, and a surface of the side core 212*a* on which the side fixing member 218 is disposed may be called an outer surface. Similarly, a surface of the second side core 212*b*, which is coupled to the bobbin 213 may be called an inner surface, a surface of the side core 212*a* on which the side fixing member 218 is disposed may be called an outer surface. Thus, it may be understood that the bobbin 213 is disposed between the inner surface of the first side core 212*a* and the inner surface of the second side core 212*b*.

According to the above-described constitutions, the center core 211 and the first and second side cores 212*a* and 212*b* may be disposed to surround the coil winding bodies 213 and 215.

The protrusion 217*a* of each of the first and second side cores 212*a* and 212*b* may include a hook 217*b* coupled to a hook coupling part 211*a* of the center core 211. The hook 217*b* may be understood as a portion of the protrusion 217*b*, which is inserted into the hook coupling part 211*a*.

The hook coupling part 211*a* may be understood as a component for guiding the coupling of the hook 217*b* of each of the side cores 212*a* and 212*b*.

In detail, the hook coupling part 211*a* may include a recess part in the outer circumferential surface of the center core 217*b* so that the hook 217*b* is inserted into the recess part. The recess part may extend along a circumference of the center core 211 and have a circular shape.

Also, the hook coupling part 211*a* may be provided in plurality on the outer circumferential surface of the center core 211. In detail, the hook coupling part 211*a* may be provided on two positions corresponding to portions to which the first and second side cores 212*a* and 212*b* are coupled.

Since the hook 217*b* is disposed on each of the first and second side cores 212*a* and 212*b* and coupled to the center core 211, deformation of the first and second side cores 212*a* and 212*b* by external force occurring when the first and second side cores 212*a* and 212*b* are fitted into the outside of the center core 211 may be prevented.

Also, when the stator cover 240 and the frame 110 are assembled with the outside of the first and second side cores 212*a* and 212*b*, the outward spreading of the outer circumferential surface of each of the first and second cores 212*a* and 212*b*, i.e., a portion on which the tip 216 is disposed, by external force transmitted from the stator cover 240 or the frame 110 may be prevented.

Referring to FIG. 8, when the center core 211 and the first and second side cores 212*a* and 212*b* are assembled according to the first embodiment, the hooks 217*b* of the first and second side cores 212*a* and 212*b* may be firmly coupled to the hook coupling part 211*a* of the center core 211.

Thus, a virtual line extending from the outer circumferential surface of the first side core 212*a* may match a virtual line extending from the outer circumferential surface of the second side core 212*b* (l3). As described above, since the deformation of the first and second side cores 212*a* and 212*b* is prevented, the air gap between the inner stator 210 and the outer stator 220 may be maintained within a preset range to improve the operation efficiency of the linear motor.

Hereinafter, descriptions will be made according to a second embodiment. Since the current embodiment is the same as the first embodiment except for portions of the constitutions, different parts between the first and second embodiments will be described principally, and descriptions of the same parts will be denoted by the same reference numerals and descriptions of the first embodiment.

Figure 9:
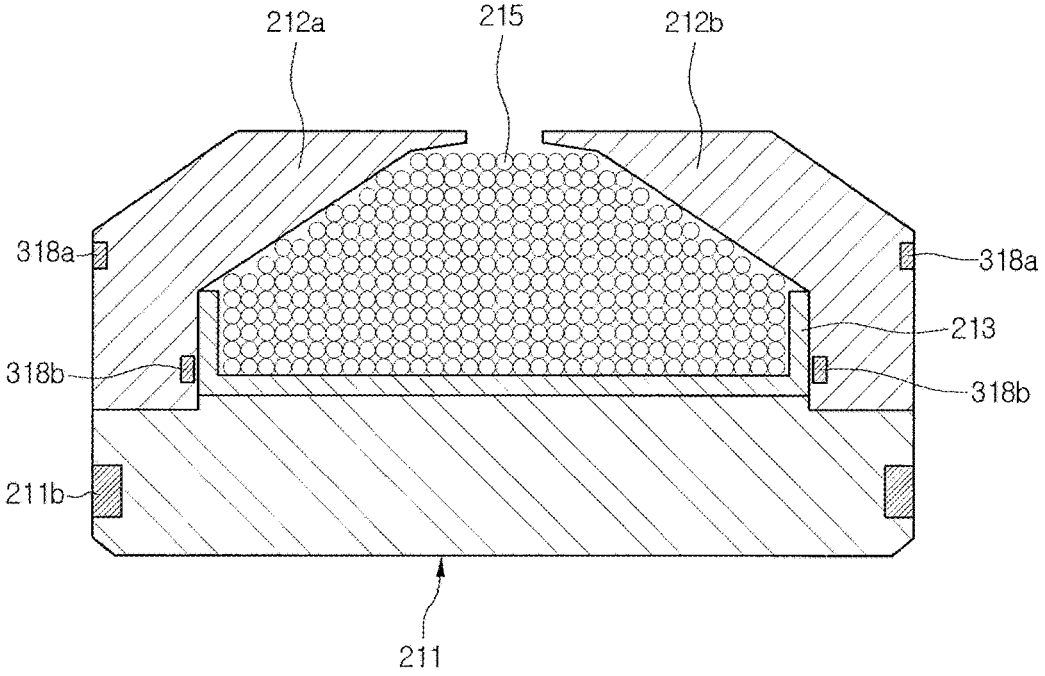
FIG. 9 is a cross-sectional view illustrating an inner stator of a linear compressor according to a second embodiment.
Figure 10:
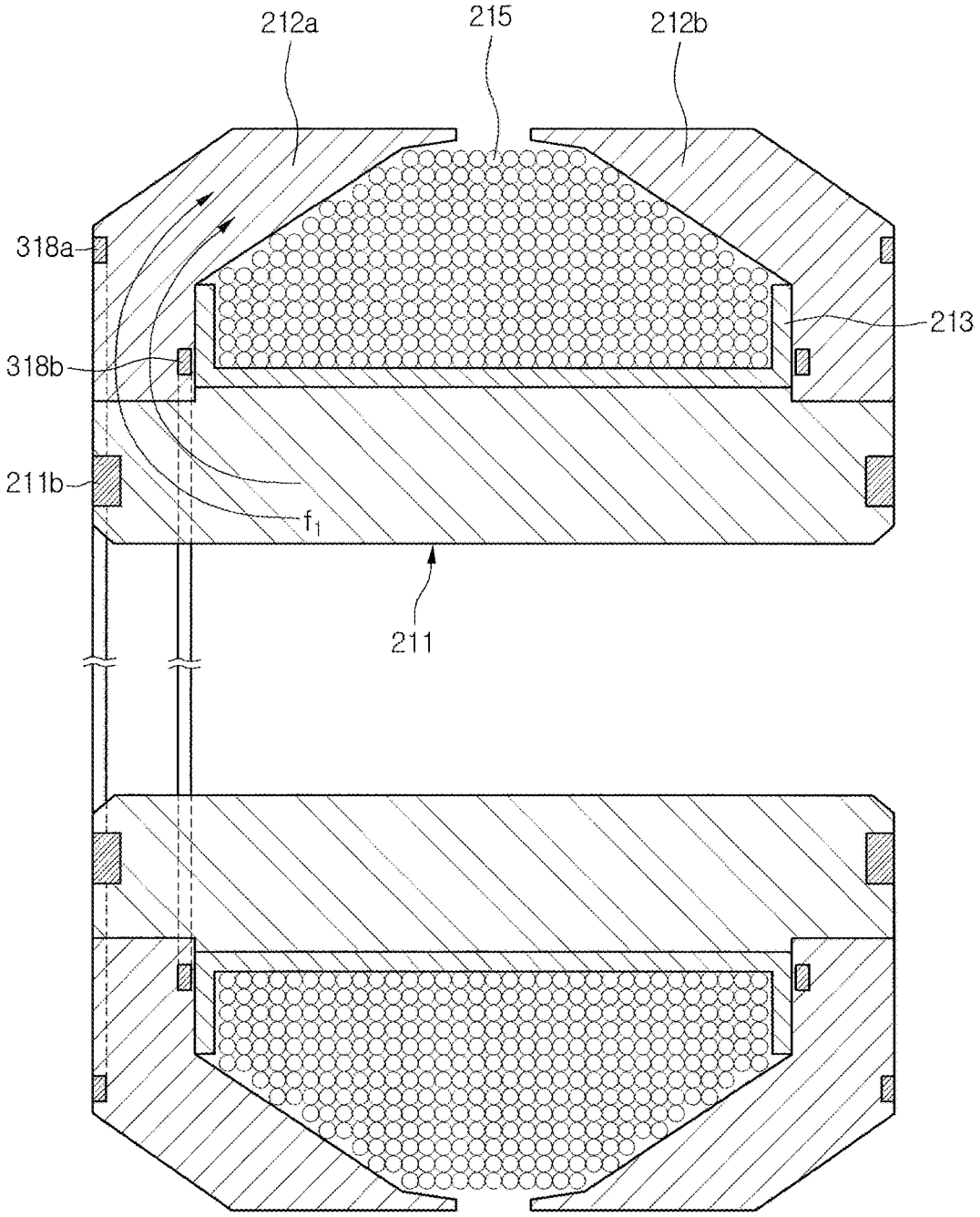
FIG. 10 is a view illustrating a state in which flux flows in the liner motor according to the second embodiment.

FIG. 9 is a cross-sectional view illustrating an inner stator of a linear compressor according to a second embodiment, and FIG. 10 is a view illustrating a state in which flux flows in the liner motor according to the second embodiment.

Referring to FIG. 9, each of side cores 212*a* and 212*b* according to a second embodiment includes a first fixing member 318*a* disposed on an outer circumferential surface of each of the side cores 212*a* and 212*b* and a second fixing member 318*b* disposed on an inner circumferential surface 318*b* of each of the side cores 212*a* and 212*b*.

The outer circumferential surface of the first side core 212*a* may be understood as a surface that faces a stator cover 240, and the inner circumferential surface of the first side core 212*a* may be understood as a surface that is coupled to a bobbin 213.

Also, the first and second fixing members 318*a* and 318*b* disposed on the first side core 212*a* may be understood as members for fixing a plurality of core plates 219 constituting the first side core 212*a*.

The outer circumferential surface of the second side core 212*b* may be understood as a surface that faces the frame 110, and the inner circumferential surface of the second side core 212*b* may be understood as a surface that is coupled to the bobbin 213.

Also, the first and second fixing members 318*a* and 318*b* disposed on the second side core 212*b* may be understood as members for fixing a plurality of core plates 219 constituting the second side core 212*b*.

As described above, since the fixing members 318*a* and 38*b* are disposed on the inner and outer circumferential surfaces of the side cores 212*a* and 212*b*, deformation of the side cores 212*a* and 212*b* may be prevented. That is, since the assembled state of the plurality of core plates 219 constituting the side cores 212*a* and 212*b* is maintained by the fixing members 318*a* and 318*b*, the deformation in which the side cores 212*a* and 212*b* are spread outward may be prevented.

Since each of the first and second fixing members 318*a* and 318*b* has a ring shape, the first and second fixing members 318*a* and 318*b* may be called a "first ring member" and "second ring member" or an "outer ring" and "inner ring", respectively.

The second fixing member 318*b* may be formed of a nonconductive material. For example, the nonconductive material may include plastic.

Referring to FIG. 10, when the linear compressor 10 operates, current is applied to the linear motor. Thus, flux may flow through the center core 211 in an arrow direction. The flux may flow in one direction (a solid arrow) or the other direction along the direction of the current applied to the coil 215.

Here, the flux may be provided into the inner surfaces of the first and second side cores 212*a* and 212*b*. The flux may pass through the second fixing member 318*b*, but not pass through the first fixing member 318*a*. That is, the flux may pass through the inside of the second fixing member 318*b* having the ring shape to flow toward the center core 211 or the side cores 212*a* and 212*b*.

Since the flux does not pass through the first fixing member 318*a*, eddy current due to the first fixing member 318*a* may not occur. Thus, a loss due to the eddy current may not occur.

On the other hand, while the flux passes through the second fixing member 318*b*, the eddy current due to the second fixing member may occur, and thus, the loss due to the eddy current may occur. Thus, to prevent the eddy current due to the second fixing member 318*b* from occurring, the second fixing member may be formed of a nonconductive material.

The hook 217*b* and the hook coupling part 211*a* according to the first embodiment and the first and second fixing members 318*a* and 318*b* according to the second embodiment may be devices for prevent the side cores 212*a* and 212*b* from being deformed. Thus, a combination of the hook 217*b* and the hook coupling part 211*a*, and a combination of the first and second fixing members 318*a* and 318*b* may be respectively called a "deformation prevention device".

According to the embodiments, the deformation of the side core constituting the inner stator may be prevented to maintain an air gap, which is defined between the inner stator and the outer stator, within a required range, thereby improving the operation efficiency of the linear motor.

Particularly, since the side core is hook-coupled to the center core, the outward spreading of the inner surface of the side core may be prevented.

Also, since the fixing member for coupling the core plate constituting the side core is disposed on each of the inner and outer surfaces of the side core, the deformation of the side core may be prevented.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A linear compressor comprising:

a frame and a stator cover;

a cylinder coupled to the frame, the cylinder defining a compression space;

a piston configured to reciprocate in a direction of an axis of the cylinder within the compression space defined by the cylinder; and a linear motor configured to provide power to the piston, wherein the linear motor comprises:

an inner stator disposed outside of the compression space defined by the cylinder, the inner stator comprising:

a center core having a hollow cylindrical shape, a pair of side cores that are disposed on a first side of the center core and a second side of the center core, respectively, the pair of side cores comprising a first side core coupled to a front portion of the center core and a second side core coupled to a rear portion of the center core, each of the first and second side cores having a hollow cylindrical shape, and a bobbin disposed at and coupled to the pair of side cores;

an outer stator that is spaced outward from the inner stator in a radius direction;

a magnet disposed in an air gap defined between the inner stator and the outer stator, the magnet being configured to move within the air gap defined between the inner stator and the outer stator and reciprocate the piston based on movement of the magnet, wherein the first side core has a first inner surface coupled to the bobbin and a first outer surface coupled to the stator cover, wherein the second side core has a second inner surface coupled to the bobbin and a second outer surface coupled to the frame, and wherein the first side core surrounds the front portion of the center core, and the second side core surrounds the rear portion of the center core.

2. The linear compressor according to claim 1, further comprising a deformation prevention device that includes:

a hook disposed on at least one of the first side core or the second side core; and a hook coupling part disposed on the center core and configured to be coupled to the hook, wherein the deformation prevention device is configured to prevent the inner stator from being deformed.

3. The linear compressor according to claim 2, wherein each of the first side core and the second side core of the inner stator comprises:

a core body coupled to the stator cover or the frame of the linear compressor;

a tip extending from a first side of the core body; and a protrusion protruding from a second side of the core body, wherein the hook of the deformation prevention device is disposed on the protrusion.

4. The linear compressor according to claim 2, wherein the hook coupling part defines a recess part that is recessed in an outer circumferential surface of the center core and configured to receive the hook.

5. The linear compressor according to claim 1, wherein a first tip disposed on the first side core and a second tip disposed on the second side core are spaced apart from each other and face each other.

6. The linear compressor according to claim 1, wherein the inner stator further comprises a coil wound around the bobbin.

7. The linear compressor according to claim 1, wherein each of the first side core and the second side core comprises:

a plurality of core plates that are stacked on each other in a circumferential or a radial direction.

8. The linear compressor according to claim 7, wherein at least one of the first side core or the second side core further comprises a side fixing ring coupled to the plurality of core plates to maintain an assembled state of the plurality of core plates.

9. The linear compressor according to claim 7, further comprising a deformation prevention device that includes:

a first fixing ring disposed on a first surface of at least one of the first side core or the second side core to fix the plurality of core plates; and a second fixing ring disposed on a second surface of at least one of the first side core or the second side core to fix the plurality of core plates, wherein the deformation prevention device is configured to prevent the inner stator from being deformed.

10. The linear compressor according to claim 9, wherein an outer surface of at least one of the first side core or the second side core comprises a portion coupled to the bobbin around which a coil is wound.

11. The linear compressor according to claim 9, wherein the second fixing ring comprises a nonconductive material.

12. The linear compressor according to claim 1, wherein the cylinder defines a compression space configured to receive and compress a refrigerant.

13. The linear compressor according to claim 1, wherein the piston is configured to reciprocate in an axial direction within the cylinder.

14. The linear compressor according to claim 1, wherein the inner stator is disposed outside of the cylinder.

15. The linear compressor according to claim 1, wherein the first side core is spaced apart from the second side core.

16. A linear compressor comprising:

a frame;

a cylinder coupled to the frame, the cylinder defining a compression space;

a piston configured to reciprocate in a direction of an axis of the cylinder within the compression space defined by the cylinder; and a linear motor configured to provide power to the piston, wherein the linear motor comprises:

an inner stator disposed outside of the compression space defined by the cylinder, the inner stator comprising:

a center core having a hollow cylindrical shape, first and second side cores that are coupled to a first side of the center core and a second side of the center core, respectively, each of the first and second cores having a hollow cylindrical shape, a bobbin disposed in a space defined by the center core and the pair of side cores, and a coil coupled to the bobbin;

an outer stator that is spaced outward from the inner stator in a radius direction;

a magnet disposed in an air gap defined between the inner stator and the outer stator, the magnet being configured to move within the air gap defined between the inner stator and the outer stator and reciprocate the piston based on movement of the magnet; and a hook disposed on each of the pair of side cores; and a groove defined on the center core and configured to be coupled to the hook, and wherein the first side core surrounds a first portion of the center core, and the second side core surrounds a second portion of the center core.

17. The linear compressor according to claim 16, wherein each of the first side core and the second side core comprises:

a plurality of core plates that are stacked on each other; and a side fixing ring coupled to the plurality of core plates.

18. The linear compressor according to claim 16, wherein the groove includes first and second grooves that are disposed at positions corresponding to the first and second side cores.

19. The linear compressor according to claim 18, wherein the bobbin is disposed between an inner surface of the first side core and an inner surface of the second side core.

20. The linear compressor according to claim 16, wherein the first side core is spaced apart from the second side core.

21. A linear compressor comprising:

a cylinder defining a compression space;

a piston configured to reciprocate in a direction of an axis of the cylinder within the compression space defined by the cylinder;

a linear motor configured to provide power to the piston; and a stator cover disposed at an outer side of the linear motor, wherein the linear motor comprises:

an inner stator disposed outside of the compression space defined by the cylinder, the inner stator comprising:

a center core, a pair of side cores disposed on a first side of the center core and a second side of the center core, respectively, a bobbin disposed in a space defined by the center core and the pair of side cores, a first fixing ring disposed on an outer circumferential surface of one of the pair of side cores, the outer circumferential surface facing the stator cover, and a second fixing ring disposed on an inner circumferential surface of each of the pair of side cores, the inner circumferential surface being coupled to the bobbin;

an outer stator that is spaced outward from the inner stator in a radius direction; and a magnet disposed in an air gap defined between the inner stator and the outer stator, the magnet being configured to move within the air gap defined between the inner stator and the outer stator and reciprocate the piston based on movement of the magnet.

22. The linear compressor according to claim 21, wherein the second fixing ring comprises a nonconductive material.

* * * * *